US007909667B1

(12) United States Patent
Rossman et al.

(10) Patent No.: US 7,909,667 B1
(45) Date of Patent: Mar. 22, 2011

(54) CRIMP CONTACTS AND ELECTRICAL CONNECTOR ASSEMBLIES INCLUDING THE SAME

(75) Inventors: Jared Evan Rossman, Dover, PA (US); Andrew Charles Davison, Harrisburg, PA (US); Hung Wei Lord, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/786,190

(22) Filed: May 24, 2010

(51) Int. Cl.
*H01R 4/10* (2006.01)

(52) U.S. Cl. ..... 439/877; 439/882; 439/733.1; 174/84 C

(58) Field of Classification Search ..... 439/877, 439/882, 733.1; 174/84 C
See application file for complete search history.

(56) References Cited

U.S. PATENT DOCUMENTS

| | | | | |
|---|---|---|---|---|
| 4,015,889 | A | 4/1977 | Blanchet | |
| 4,580,863 | A | 4/1986 | Lohr et al. | |
| 4,653,842 | A | 3/1987 | Kirma | |
| 4,854,899 | A | 8/1989 | Matthews | |
| 5,575,691 | A | 11/1996 | Matthews | |
| 5,885,113 | A * | 3/1999 | Bricaud | 439/733.1 |
| 5,964,624 | A | 10/1999 | Pernelle | |
| 6,979,235 | B2 * | 12/2005 | Lappohn | 439/733.1 |
| 7,354,286 | B1 | 4/2008 | Lee | |
| 2009/0075527 | A1 * | 3/2009 | Osborn et al. | 439/741 |
| 2009/0117787 | A1 * | 5/2009 | Kerner | 439/877 |

OTHER PUBLICATIONS

Multi-Beam XL Power Distribution Connector System; TYCO Electronics, Catalog 1773096, Revised Jul. 2007, www.tycoelectronics.com, 94 pgs.

ELCON* Drawer Series Connectors; Application Specification 114-13206, LOC B, E2009 TYCO Electronics Corporation, Harrisburg, PA; All International Rights Reserved; Sep. 28, 2009 Rev C; 17 pgs.

Pin Contact, Part No. 1766232-1, May 2007, 1 pg.

* cited by examiner

*Primary Examiner* — Tho D Ta

(57) ABSTRACT

A crimp contact that includes an elongated contact body having loading and mating ends and a central axis extending therebetween. The contact body includes a contact wall that extends around the central axis and that defines a conductor-receiving passage of the contact body proximate to the loading end. The contact wall has an outer surface. The crimp contact also includes a sleeve wall that extends around the central axis and the outer surface of the contact wall proximate to the loading end of the contact body. The sleeve wall is sized to engage a crimping tool and the contact wall is configured to grip a conductor within the conductor-receiving passage when the sleeve and contact walls are deformed by the crimping tool.

20 Claims, 5 Drawing Sheets

CRIMP CONTACTS AND ELECTRICAL CONNECTOR ASSEMBLIES INCLUDING THE SAME

BACKGROUND OF THE INVENTION

The subject matter herein relates generally to electrical contacts and, more specifically, to crimp contacts that are compressed to grip one or more conductors and establish an electrical connection.

Conventional crimp contacts include a mating end that electrically engages a mating contact (e.g., socket or pin contact) and a loading end that includes a passage configured to receive one or more conductors (e.g., a stripped cable wire). Using a crimping tool, the crimp contact may be compressed or deformed at the loading end thereby causing the crimp contact to grip the conductors within the conductor passage. The deformed crimp contact (or crimped contact) may then be inserted into a contact cavity of a connector housing where the crimped contact is positioned to engage the mating contact from another connector.

Dimensions of crimp contacts may be set by industry or customer-specified requirements. For example, an outer diameter of the crimp contact may be sized so that a crimping tool may engage the crimp contact and compress the crimp contact in a predetermined manner. An inner diameter that defines the conductor passage may be sized to effectively engage the conductors when the crimp contact is deformed. In order to satisfy the industry or customer-specified dimensions, crimp contacts are typically machined. For example, a conductive material in the form of a block or rod may be machined (e.g., by a screw machine) to form the conductor passage of the crimp contact as well as other features. Such crimp contacts may be called screw-machine contacts. However, these manufacturing methods may be costly to perform and the removed conductive material is no longer usable.

In addition, in some electrical connector assemblies, it may be desirable to have a plurality of crimp contacts where at least some of the crimp contacts project different distances from a side of the connector housing. By projecting different distances from the side of the connector housing, a user may control an order or sequence in which the crimp contacts electrically engage the corresponding mating contacts. To provide crimp contacts that project various distances away from the connector housing, the above machining methods may be adjusted to form crimp contacts of different lengths. Again, such manufacturing methods may be costly to operate and waste the conductive material. Changing a manufacturing process to adjust the final dimensions of the crimp contacts may further increase the overall costs.

Accordingly, there is a need for crimp contacts that may be manufactured in a less costly manner than some known processes for manufacturing crimp contacts. There is also a general need from alternative crimp contacts than those currently available today.

BRIEF DESCRIPTION OF THE INVENTION

In one embodiment, a crimp contact is provided that includes an elongated contact body having loading and mating ends and a central axis extending therebetween. The contact body includes a contact wall that extends around the central axis and that defines a conductor-receiving passage of the contact body proximate to the loading end. The contact wall has an outer surface. The crimp contact also includes a sleeve wall that extends around the central axis and the outer surface of the contact wall proximate to the loading end of the contact body. The sleeve wall is sized to engage a crimping tool and the contact wall is configured to grip a conductor within the conductor-receiving passage when the sleeve and contact walls are deformed by the crimping tool.

In another embodiment, an electrical connector assembly is provided that includes a connector housing having opposite mounting and mating sides. The connector housing includes a contact cavity that extends axially through the connector housing. The contact cavity is defined by an interior surface of the connector housing. The connector assembly also includes a crimp contact that has loading and mating ends and a central axis extending therebetween. The crimp contact is held within the contact cavity and is coupled to the interior surface. The crimp contact includes an elongated contact body comprising a contact wall. The contact wall extends around the central axis and defines a conductor-receiving passage of the contact body proximate to the loading end. The contact wall has an outer surface. The crimp contact also includes a sleeve wall that extends around the central axis and the outer surface of the contact wall proximate to the loading end of the contact body. The sleeve wall is sized to engage a crimping tool and the contact wall is configured to grip a conductor within the conductor-receiving passage when the sleeve and contact walls are deformed by the crimping tool.

DETAILED DESCRIPTION OF THE INVENTION

Figure 1:
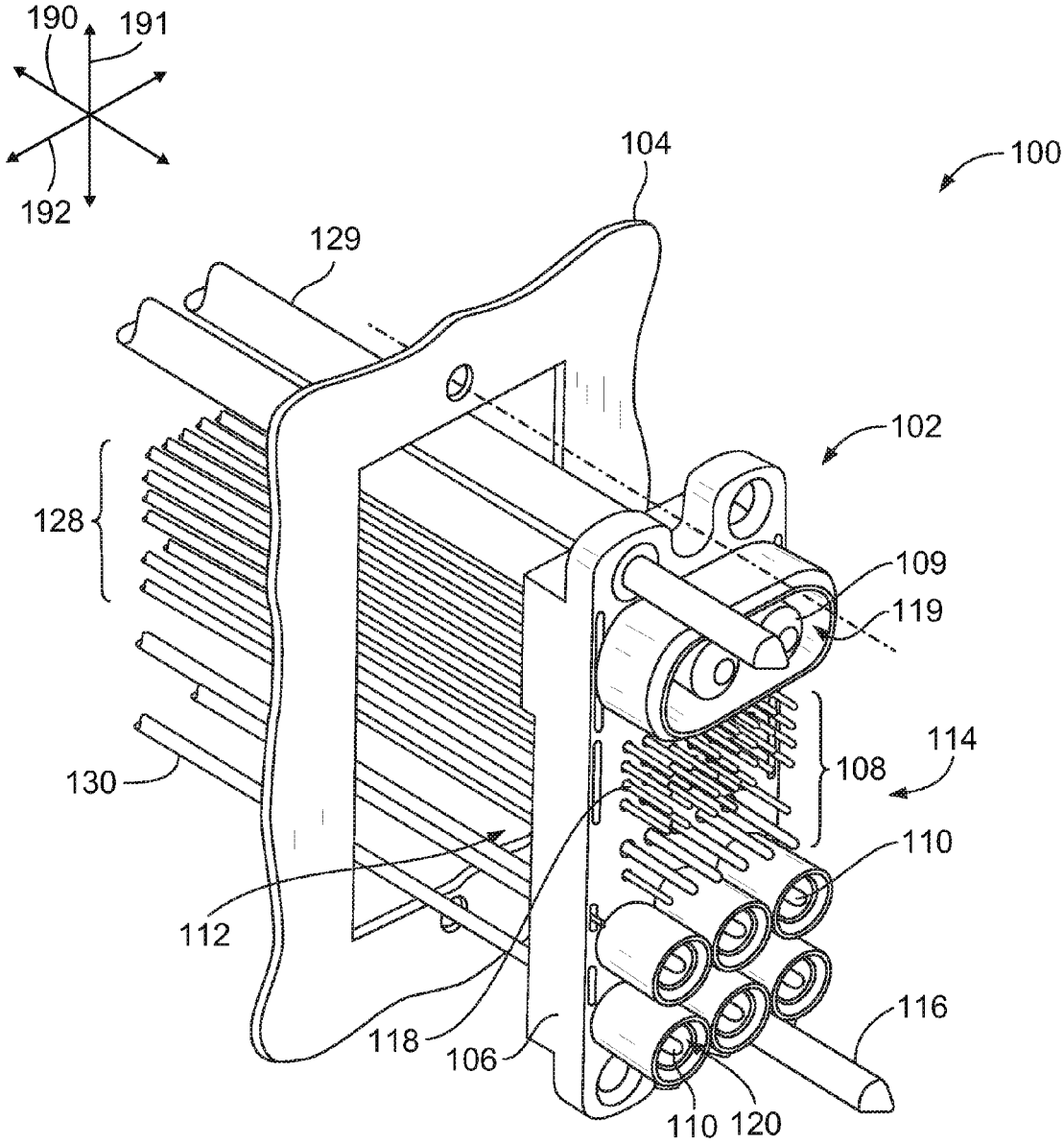
FIG. 1 is an exploded perspective view of an electrical system formed in accordance with one embodiment.

FIG. 1 is an exploded perspective view of an electrical system 100 that includes an electrical connector assembly 102 that is formed in accordance with one embodiment. The connector assembly 102 is configured to be mounted to a support structure 104 of the electrical system 100. In the illustrated embodiment, the support structure 104 includes a circuit board. However, in alternative embodiments, the support structure 104 may include a panel or other structural support that is capable of having the connector assembly 102 mounted thereto. The connector assembly 102 may be configured to communicatively engage or mate with a mating connector (not shown). For example, the connector assembly 102 may be used in pluggable wire-to-board applications and may be configured to transmit electrical data signals and power.

The connector assembly 102 includes a connector housing 106 comprising an insulative material and electrical contacts 108-110 that are held by the connector housing 106. As shown, the connector assembly 102 is oriented with respect to mutually perpendicular axes 190-192 (also referred to as a longitudinal axis 190 and lateral axes 191 and 192). The connector housing 106 includes opposite mounting and mating sides 112 and 114. The mounting side 112 is configured to be mounted to the support structure 104, and the mating side 114 is configured to engage the mating connector. The connector housing 106 is configured to hold the electrical contacts 108-110 in predetermined orientations so that the electrical contacts 108-110 may electrically engage corresponding mating contacts (not shown) of the mating connector. For example, the connector housing 106 may include contact cavities 118-120 that extend axially through the connector housing 106 (e.g., in a direction along the longitudinal axis 190). The contact cavities 118-120 may be shaped to hold the electrical contacts 108-110 in the predetermined orientations. The connector assembly 102 may also include other features, such as guide pins 116, which may facilitate engaging the mating connector.

The electrical contacts 108-110 are configured to electrically connect with corresponding conductors 128-130, respectively. The conductors 128-130 may be single conductors or a plurality of conductors that are, for example, grouped together within a cable. Before the electrical contacts 108-110 are disposed within the corresponding contact cavities 118-120, the electrical contacts 108-110 may be electrically coupled or connected to the respective conductors 128-130. By way of example only, the electrical contact 108 may be a solder-type contact in which a loading end of the electrical contact 108 is soldered to the conductor 128. The electrical contacts 109 and 110 may be crimp-type contacts in which corresponding conductor-receiving passages of the electrical contacts 109 and 110 receive the conductors 129 and 130. After interconnecting the conductors 128-130 to the corresponding electrical contacts 108-110, the electrical contacts 108-110 may be inserted into the respective contact cavities 118-120. In alternative embodiments, the electrical contacts 108-110 may be positioned within the respective contact cavities 118-120 before the conductors 118-120 are electrically connected. The electrical contacts 108-110 may couple to the connector housing 106 so that the electrical contacts 108-110 are held in fixed positions with respect to the connector housing 106. For example, the connector housing 106 may have various elements or features that form an interference fit with the electrical contacts 108-110.

Embodiments described herein include crimp contacts, such as the electrical contacts 109 and 110, which are configured to electrically engage corresponding conductors at loading ends of the crimp contacts. Embodiments also include electrical connector assemblies that include such crimp contacts. The crimp contacts may include a plurality of layers or walls that extend around a central axis and form an interface between each other. The walls (or layers) may form a crimp portion of the crimp contact that receives a conductor. The walls may have predetermined dimensions. The crimp portion is configured to be compressed or deformed radially inward by a crimping tool so that one of the walls grips the conductors. In some embodiments, the walls may be formed from a continuous sheet of material. The continuous sheet of material may be folded along a wall joint or somehow shaped to form the crimp portion of the crimp contact. In other embodiments, the walls may be separate components. For example, a separate jacket or sleeve member may be mounted to a loading end of a contact body.

Figure 2:
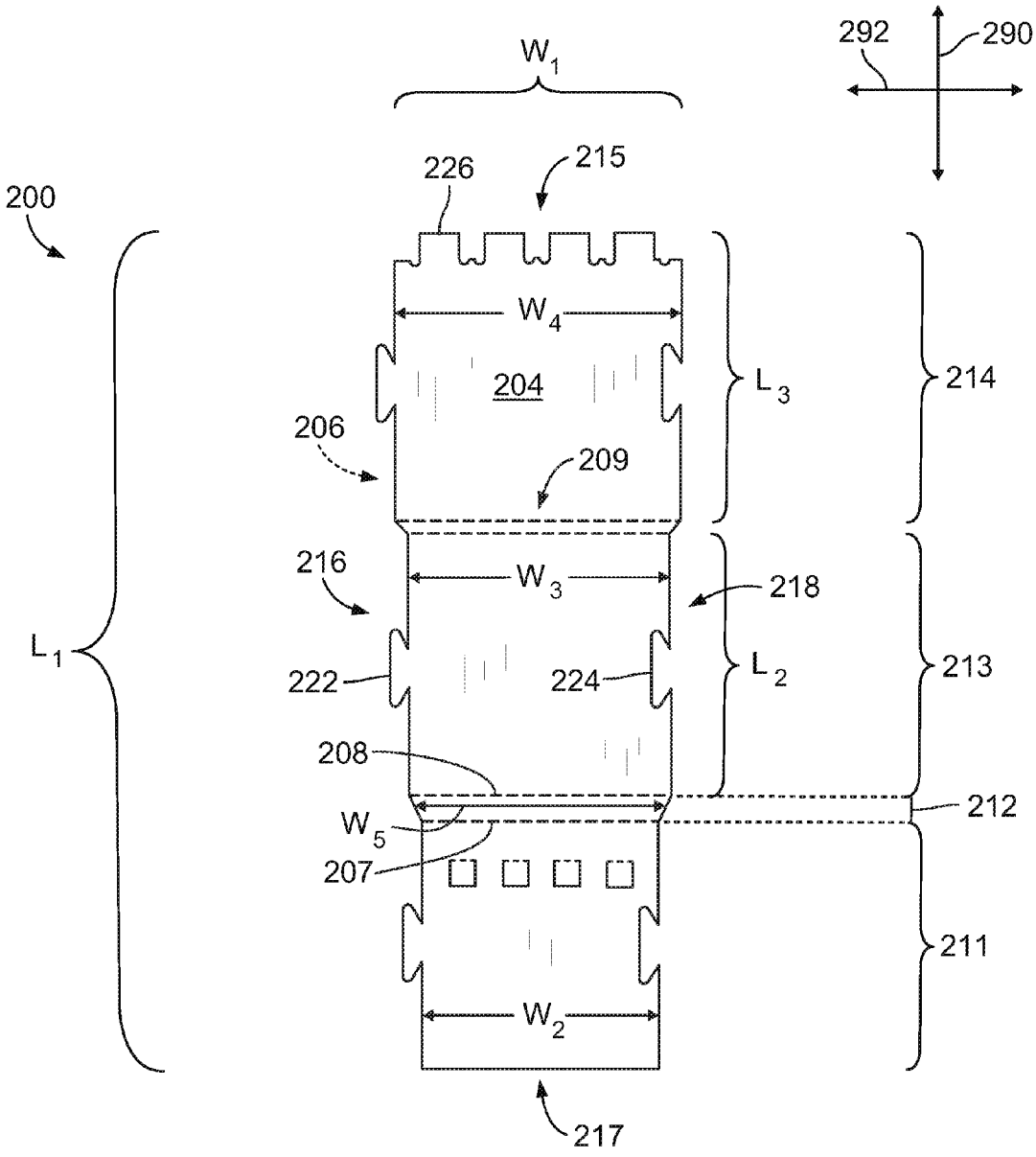
FIG. 2 is a plan view of a contact sheet of material that may be formed into a crimp contact in accordance with one embodiment.
Figure 3:
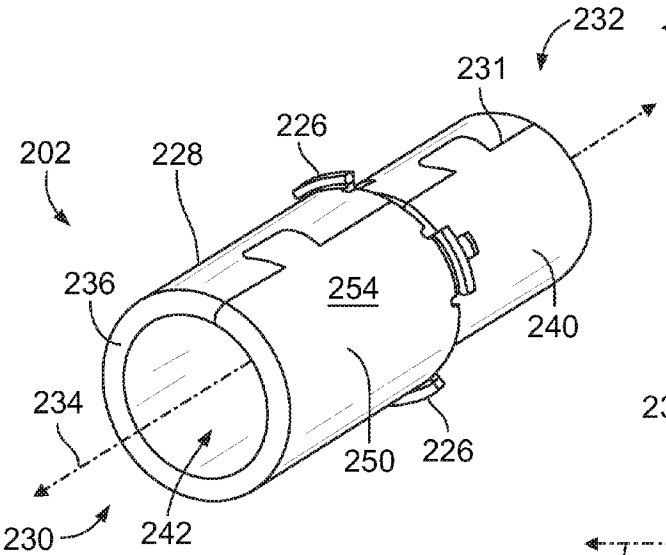
FIG. 3 is a perspective view of a crimp contact formed in accordance with one embodiment.

FIG. 2 is a plan view of a contact sheet of material 200 that may be shaped to form a crimp contact 202 (shown in FIG. 3). The contact sheet 200 is oriented with respect to a longitudinal sheet axis 290 and a lateral sheet axis 292. The contact sheet 200 has a sheet length $L_1$ and a sheet width $W_1$. As shown, the contact sheet 200 may include a plurality of sheet sections 211-214 that are defined between side edges 215-218. The sheet sections 211-214 may be coupled to each other in a series and arranged side-by-side along the longitudinal sheet axis 290 between opposite side edges 215 and 217. The contact sheet 200 may comprise one or more materials. In the illustrate embodiment, the contact sheet 200 comprises a solid material that is malleable or capable of being formed (e.g., through rolling, bending, folding, and the like) into a predetermined shape. As shown, the sheet sections 211-214 may have section borders 207-209 that indicate where the contact sheet 200 is folded, bent, rolled, or somehow shaped. The section borders 207-209 may also be referenced as fold lines or areas.

In the illustrated embodiment, the contact sheet 200 is a continuous structure such that the sheet sections 211-214 are not separate parts. For example, the contact sheet 200 may be stamped from a larger sheet of material. The larger sheet of material may comprise one type of solid material such that the contact sheet 200 is a common solid material throughout. In some embodiments, the contact sheet 200 is stamped from a sheet of a solid material that is malleable and electrically conductive. By way of example only, the material may be a copper alloy plated with silver or gold. A sheet, of material is not required to have only one type of material. For example, the plurality of sheet sections 211-214 may comprise two or more different solid materials that are bonded together (e.g., through an adhesive, soldering, welding, or mechanical means) along the section borders 207-209. As another example, the contact sheet 200 may be manufactured so that the material has different properties in different areas or regions. For example, a resin injected into a mold may have magnetic particles that are attracted to a predetermined area or region of the contact sheet 200. As another example, the contact sheet 200 may be plated.

Also shown, the contact sheet 200 may have opposite plan surfaces 204 and 206 where a thickness $T_1$ (shown in FIG. 5) of the contact sheet 200 extends therebetween. In the illustrated embodiment, the thickness $T_1$ may be substantially uniform between the side edges 215-218. In alternative embodiments, the thickness $T_1$ may be different at different portions of the contact sheet 200. For example, the sheet section 214 may have a thickness that is different from a thickness of the sheet section 213. Furthermore, the plan surfaces 204 and 206 may be modified in predetermined areas. For example, the plan surfaces 204 and 206 may have a chemical substance (e.g., adhesive) deposited thereon or may be machined or etched to have predetermined surface properties.

As shown in FIG. 2, the side edges 215-218 may have predetermined elements or features that facilitate forming the contact sheet 200 into the crimp contact 202 (FIG. 3). For example, the side edge 216 may have coupling projections 222 that project away from the contact sheet 200 in a direction along the lateral sheet axis 292. The side edge 218 may have corresponding coupling recesses 224 that project into the contact sheet 200. The coupling recesses 224 may be cut-outs that occur when the contact sheet 200 is stamped from a larger sheet of material. The coupling projections and recesses 222 and 224 may be shaped relative to each other so that the corresponding coupling projections and recesses 222 and 224 interlock with each other. The coupling projections and recesses 222 and 224 may form an interference fit when the contact sheet 200 is shaped. In the illustrated embodiment, the coupling projections 222 have a dovetail-like shape; however, the coupling projections and recesses 222 and 224 may have other shapes. Also shown in FIG. 2, the contact sheet 200 may have locking projections 226 that project away from the side edge 215 in a direction along the longitudinal sheet axis 290.

The sheet sections 211-214 may have predetermined sizes, dimensions, and shapes for forming the crimp contact 202. For example, the sheet sections 213 and 214 may have axial lengths $L_2$ and $L_3$. The axial lengths $L_2$ and $L_3$ may be substantially equal. Moreover, the coupling projections 222 of the sheet sections 213 and 214 may be located along the corresponding side edge 216 so that, when the contact sheet 200 is folded over the section border 209, the coupling projections 222 substantially overlap each other. Likewise, the coupling recesses 224 of the sheet sections 213 and 214 may be located along the corresponding side edge 218 so that, when the contact sheet 200 is folded over the section border 209, the coupling recesses 224 substantially overlap each other. In alternative embodiments, at least one of the sheet sections 213 and 214 does not include coupling projections 222 or coupling recesses 222 and 224. Furthermore, in other embodiments, each side edge 216 and 218 may include at least one coupling projection and at least one coupling recess.

Also shown, the sheet sections 211, 213, and 214 may have respective widths $W_2$, $W_3$, and $W_4$. The width $W_4$ may be greater than the width $W_3$, which may be greater than the width $W_2$. A width $W_5$ of the sheet section 212 may gradually increase or decrease as the sheet section 212 extends along the longitudinal sheet axis 290 between the side edges 215 and 217. When the contact sheet 200 is shaped, the different widths $W_2$, $W_3$, and $W_4$ may account for circumferences or perimeters of different portions of the crimp contact 202. Also shown, the sheet section 211 can have tabs 274 that are capable of being partially folded or flexed.

The contact sheet 200 may be shaped to form the crimp contact 202 (FIG. 3). In the illustrated embodiment, the sheet section 214 may be folded onto the sheet section 213 at the section border 209 such that the plan surface 206 is folded onto itself (i.e., the plan surface 206 of the sheet section 214 interfaces with the plan surface 206 of the sheet section 213). The section border 209 may become a wall joint 236 as shown in FIG. 3. The sheet sections 211 and 212 may be bent or folded with respect to each other at the section border 207 such that the sheet sections 211 and 212 form a non-orthogonal angle. Similarly, the sheet sections 212 and 213 may be bent or folded at the section border 208 to form another non-orthogonal angle. The sheet sections 211 and 213 may extend substantially parallel with each other and joined by the sheet section 212. In such embodiments, the sheet section 212 would extend into the page as shown in FIG. 2 at the non-orthogonal angle with respect to the sheet section 211.

Before or after bending the sheet sections 211-213, the locking projections 226 may be shaped to project away from the sheet section 214. The contact sheet 200 may then be rolled about an axis (e.g., a central axis 234 shown in FIG. 3) to have a curved contour. The contact sheet 200 may be rolled to have a circular cross-section. However, in alternative embodiments, the crimp contact 202 may have other geometrically shaped cross-sections (e.g., square, rectangular, or a partially curved and partially planar cross-section). When the contact sheet 200 is shaped about the central axis 234, the coupling projections and recesses 222 and 224 may interlock with each other so that the contact sheet 200 is retained in the predetermined shape. The side edges 216 and 218 may directly abut each other along an interface 231 (shown in FIGS. 3 and 4).

Figure 4:
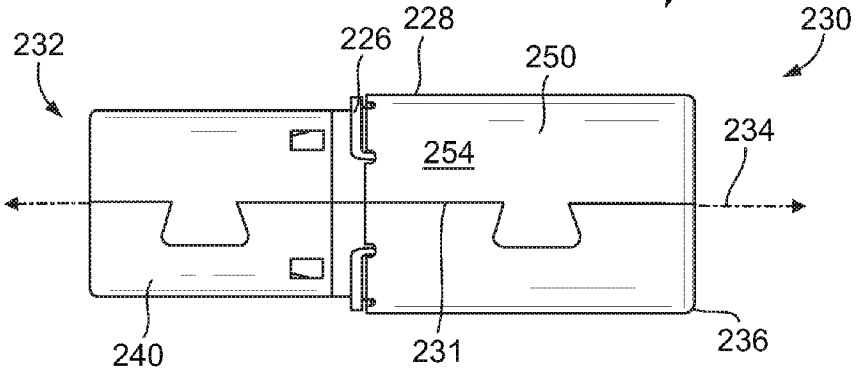
FIG. 4 is a side view of the crimp contact of FIG. 3.
Figure 5:
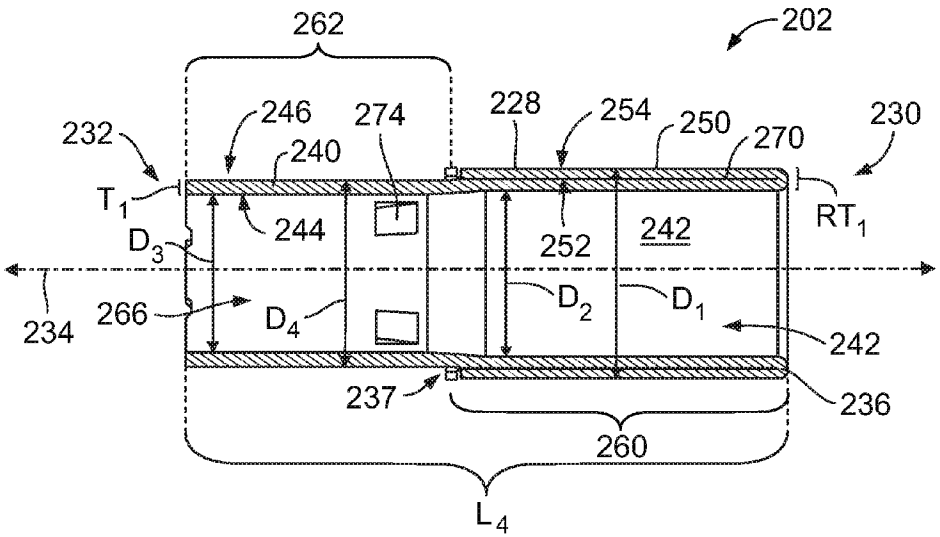
FIG. 5 is a cross-sectional view of the crimp contact of FIG. 3.

FIGS. 3-5 illustrate the crimp contact 202 formed in accordance with one embodiment. The crimp contact 202 may have an elongated contact body 228 that includes a loading end 230, a mating end 232, and a central axis 234 extending therebetween. The crimp contact 202 may be formed as described above by shaping the contact sheet 200 (FIG. 2). Alternatively, the crimp contact 202 may be formed in other manners. For example, the crimp contact 202 may be partially shaped from a sheet of material and partially machined. As shown, the crimp contact 202 includes a contact wall 240 that extends around the central axis 234 and defines a conductor-receiving passage 242 (FIGS. 3 and 5) of the contact body 228 proximate to the loading end 230. In embodiments where the crimp contact 202 is shaped from the contact sheet 200 (FIG. 2), the sheet sections 211-213 (FIG. 2) become the contact wall 240. As shown in FIG. 5, the contact wall 240 has an inner surface 244 that faces radially inward toward the central axis 234 and an outer surface 246 that faces radially outward away from the central axis 234. The contact wall 240 may extend substantially an entire axial length $L_4$ (FIG. 5) of the contact body 228.

The crimp contact 202 also includes a sleeve wall 250 that covers at least a portion of the contact wall 240. In the illustrated embodiment, the sleeve wall 250 extends completely around the central axis 234 and the outer surface 246 of the contact wall 240 proximate to the loading end 230. However, in alternative embodiments, the sleeve wall 250 may extend around only a portion or different portions of the contact wall 240. In embodiments where the crimp contact 202 is shaped from the contact sheet 200, the sheet section 214 (FIG. 2) becomes the sleeve wall 250. As shown in FIG. 5, the sleeve wall 250 has an inner surface 252 and an outer surface 254. The inner surface 252 may form an interface 270 with the outer surface of the 246 of the contact wall 240. The interface 270 includes the inner and outer surfaces 252 and 246 directly abutting and making intimate contact with each other. The sleeve and contact walls 250 and 240 may substantially function as a single wall. As such, when the sleeve wall 250 is deformed inwardly the contact wall 240 is immediately affected or displaced by the deformed sleeve wall 250. However, in alternative embodiments, a small gap may exist therebetween. As shown in FIGS. 3 and 4, the locking projections 226 extend radially outward from the outer surface 254.

As shown in FIG. 5, the interface 270 extends from the wall joint 236 to a wall end 237 of the sleeve wall 250. The wall end 237 includes the side edge 215 (FIG. 2) in the illustrated embodiment. However, in alternative embodiments, the interface 270 may exist for only a portion of the axial length between the wall joint 236 and the wall end 237. In some embodiments, the interface 270 may only exist for a portion of the sleeve wall 250 that contacts the crimping tool.

In the illustrated embodiment, both the inner surface 252 and the outer surface 246 are formed from the plan surface 206 (FIG. 2) of the contact sheet 200. The sleeve wall 250 may extend along the central axis 234 for only a portion of the axial length $L_4$. For example, the sleeve wall 250 may extend only about half the axial length $L_4$. The contact wall 240 projects beyond the sleeve wall 250 to the mating end 232. In alternative embodiments, the sleeve wall 250 may extend more than or less than about half the axial length $L_4$.

With specific reference to FIG. 5, the sleeve wall 250 is sized to engage a crimping tool (not shown) and the contact wall 240 is configured to grip a conductor (not shown) within the conductor-receiving passage 242 when the sleeve and contact walls 250 and 240 are deformed by the crimping tool. For example, the crimp contact 202 may have an outer diameter $D_1$ that extends through the central axis 234 between opposite portions of the outer surface 254 of the sleeve wall 250. The crimp contact 202 may also have an inner diameter $D_2$ that extends through the central axis 234 between opposite portions of the inner surface 244 of the contact wall 240. The contact and sleeve walls 240 and 250 may form a substantially continuous radial thickness $RT_1$ of the crimp contact 202. The radial thickness $RT_1$ may be sized and shaped to deform in a predetermined manner so that the contact wall 240 effectively grips the conductor. For example, the contact wall 240 may be deformed in a manner that mechanically holds the conductor and establishes a sufficient electrical connection with the conductor.

The crimp contact 202 can include a crimp portion 260 and an engagement portion 262. The crimp portion 260 is located proximate to the loading end 230 and is configured to be deformed by the crimping tool. The crimp portion 260 includes the overlapping contact and sleeve walls 240 and 250 proximate to the loading end 230 and the conductor-receiving passage 242. The engagement portion 262 is configured to establish an electrical connection with an electrical element (e.g., mating contact). In the illustrated embodiment, the engagement portion 262 may establish an electrical connection with the electrical element without deformation of the engagement portion 262. For example, the engagement portion 262 may removably engage a mating contact such that the engagement portion 262 is readily separated from the mating contact without damage to the mating contact or the engagement portion 262.

In the illustrated embodiment, the engagement portion 262 is exclusively formed from the contact wall 240. However, in some embodiments, the engagement portion 262 may include the sleeve wall 250. The engagement portion 262 includes a contact passage 266 that is defined by the inner surface 244 of the contact wall 240. Accordingly, the inner surface 244 may define the contact passage and the conductor-receiving passage 242. The contact and conductor-receiving passages 266 and 242 may be in fluid communication with each other (e.g., the contact and conductor-receiving passages 266 and 242 may be portions of a single passage).

For each of the crimp and engagement portions 260 and 262, the contact wall 240 may be shaped to have different dimensions. For example, the contact wall 240 may be shaped to have different diameters in the crimp and engagement portions 260 and 262. As shown, the engagement portion 262 has inner and outer diameters $D_3$ and $D_4$. In the illustrated embodiment, the inner diameter $D_3$ is smaller than the inner diameter $D_2$ of the crimp portion 260. However, in alternative embodiments, the inner diameter $D_3$ may be substantially equal to or greater than the inner diameter $D_2$. Also shown in FIG. 5, the engagement portion 262 may include inwardly projecting tabs 274. The tabs 274 may be stamped from the contact sheet 200 (FIG. 2) and facilitate holding or engaging an electrical element within the contact passage 266. For example, the tabs 274 may hold a conductive band (not shown) within the contact passage 266 that electrically connects with a mating contact.

Figure 6:
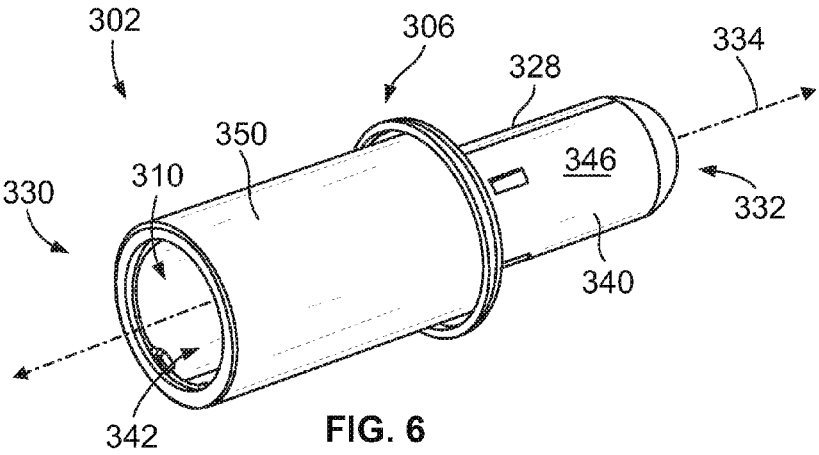
FIG. 6 is a perspective view of a crimp contact formed in accordance with another embodiment that includes a sleeve member.
Figure 7:
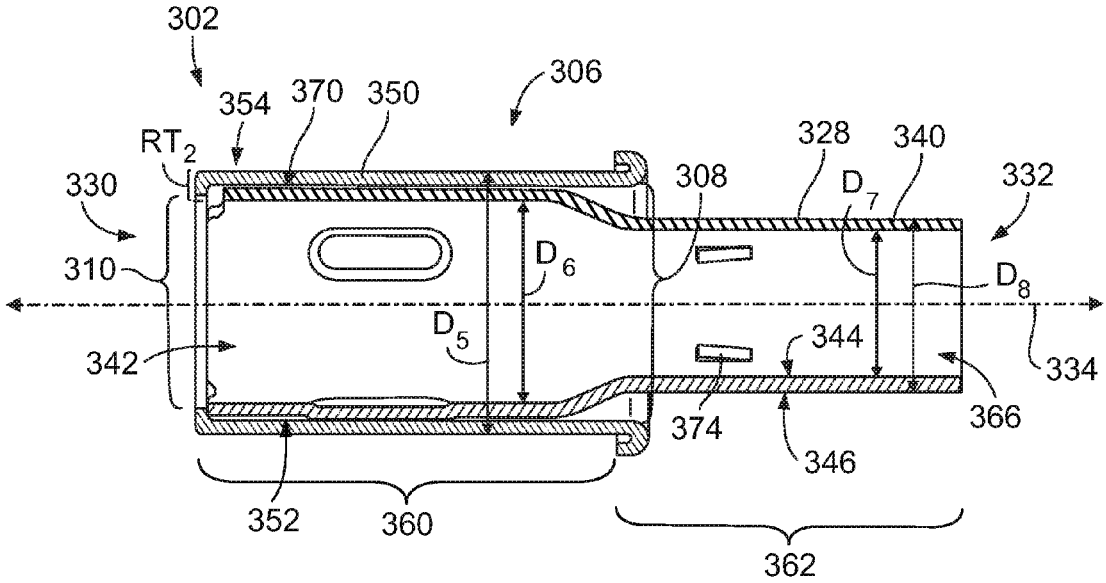
FIG. 7 is a cross-sectional view of the crimp contact of FIG. 6.

FIGS. 6 and 7 illustrate a crimp contact 302 formed in accordance with another embodiment. The crimp contact 302 may have similar features as the crimp contact 202 (FIG. 3). The crimp contact 302 may be manufactured by various processes. For example, the crimp contact 302 or different components of the crimp contact 302 may be stamped and formed and/or machined. As shown in FIGS. 6 and 7, the crimp contact 302 includes an elongated contact body 328 that has loading and mating ends 330 and 332 and a central axis 334 extending therebetween. The contact body 328 includes a contact wall 340 that extends around the central axis 334 and defines a conductor-receiving passage 342 proximate to the loading end 330. The contact wall 340 has an outer surface 346. Also shown, the crimp contact 302 includes a sleeve wall 350 that extends around the central axis 334 and forms an interface 370 (FIG. 7) with the outer surface 346 of the contact wall 340 proximate to the loading end 330. The sleeve wall 350 is sized to engage a crimping tool (not shown) and the contact wall 340 is configured to grip a conductor (not shown) within the conductor-receiving passage 342 when the sleeve and contact walls 350 and 340 are deformed by the crimping tool.

Also shown in FIGS. 6 and 7, the sleeve wall 350 is shaped to form a separate sleeve member 306 that is mounted to the contact body 328. The sleeve member 306 has a body-receiving cavity 308 (FIG. 7). The sleeve and contact walls 350 and 340 are separate components, unlike the sleeve and contact walls 250 and 240 of the crimp contact 202. The sleeve member 306 is configured to be mounted to the contact body 328 at the loading end 330. For example, the body-receiving cavity 308 may be sized and shaped to receive the contact wall 340 of the contact body 328 and form an interference fit therewith. The sleeve member 306 may be stamped and formed or machined. The sleeve member 306 may also have an aperture 310 that permits the conductor(s) to access the conductor-receiving passage 342.

With specific reference to FIG. 7, the sleeve wall 350 (and sleeve member 306) is sized to engage the crimping tool and the contact wall 340 is configured to grip a conductor (not shown) within the conductor-receiving passage 342 when the sleeve and contact walls 350 and 340 are deformed by the crimping tool. For example, the crimp contact 302 may have an outer diameter $D_5$ that extends through the central axis 334 between opposite portions of an outer surface 354 of the sleeve wall 350. The crimp contact 302 may also have an inner diameter $D_6$ that extends through the central axis 334 between opposite portions of an inner surface 344 of the contact wall 340.

The contact and sleeve walls 340 and 350 may form a substantially continuous radial thickness $RT_2$ of the crimp contact 302. The radial thickness $RT_2$ may be sized and shaped to deform in a predetermined manner so that the contact wall 340 effectively grips the conductor. For example, an inner surface 352 of the sleeve wall 350 and the outer surface 346 can directly abut each other at the interface 370. The sleeve and contact walls 350 and 340 may substantially function as a single wall. When the sleeve wall 350 is deformed inwardly, the contact wall 340 can be immediately affected or displaced by the deformed sleeve wall 350. However, in alternative embodiments, a small gap may exist therebetween.

The crimp contact 302 also includes a crimp portion 360 and an engagement portion 362. The crimp portion 360 is located proximate to the loading end 330 and is configured to be deformed by the crimping tool. The crimp portion 360 includes the overlapping contact and sleeve walls 340 and 350 proximate to the loading end 330 and the conductor-receiving passage 342. In the illustrated embodiment, the engagement portion 362 is exclusively formed from the contact wall 340. However, in some embodiments, the engagement portion 362 may include the sleeve wall 350. The engagement portion 362 includes a contact passage 366 that is defined by the inner surface 344 of the contact wall 340. The engagement portion 362 has inner and outer diameters $D_7$ and $D_8$. In the illustrated embodiment, the inner diameter $D_7$ is smaller than the inner diameter $D_6$ of the crimp portion 360. However, in alternative embodiments, the inner diameter $D_7$ may be substantially equal to or greater than the inner diameter $D_6$. Also shown in FIG. 7, the engagement portion 362 may include inwardly projecting tabs 374. The tabs 374 may facilitate holding or engaging an electrical element within the contact passage 366.

Figure 8:
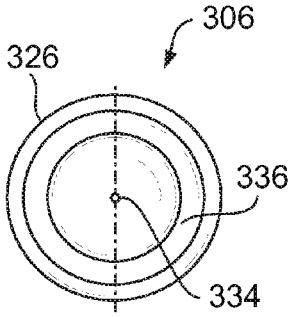
FIG. 8 is an end view of the sleeve member that may be used by the crimp contact of FIG. 6.

FIG. 8 is an end view of the sleeve member 306. The sleeve member 306 may include a wall joint 336 that extends radially inward from the loading end 330 of the crimp contact 302 (FIG. 6). The wall joint 336 may provide a positive stop for the contact body 328 (FIG. 6) when the contact body 328 is inserted into the body-receiving cavity 308 (FIG. 7) of the sleeve member 306. Also shown, the sleeve member 306 may include a locking feature 326 that projects radially outward from the sleeve member 306. The locking feature 326 may be shaped like a rim or lip that extends completely around the circumference of the sleeve member 306. In alternative embodiments, the locking feature 326 may include locking projections similar to the locking projections 226 shown in FIG. 3 that are distributed about the central axis 334.

Figure 9:
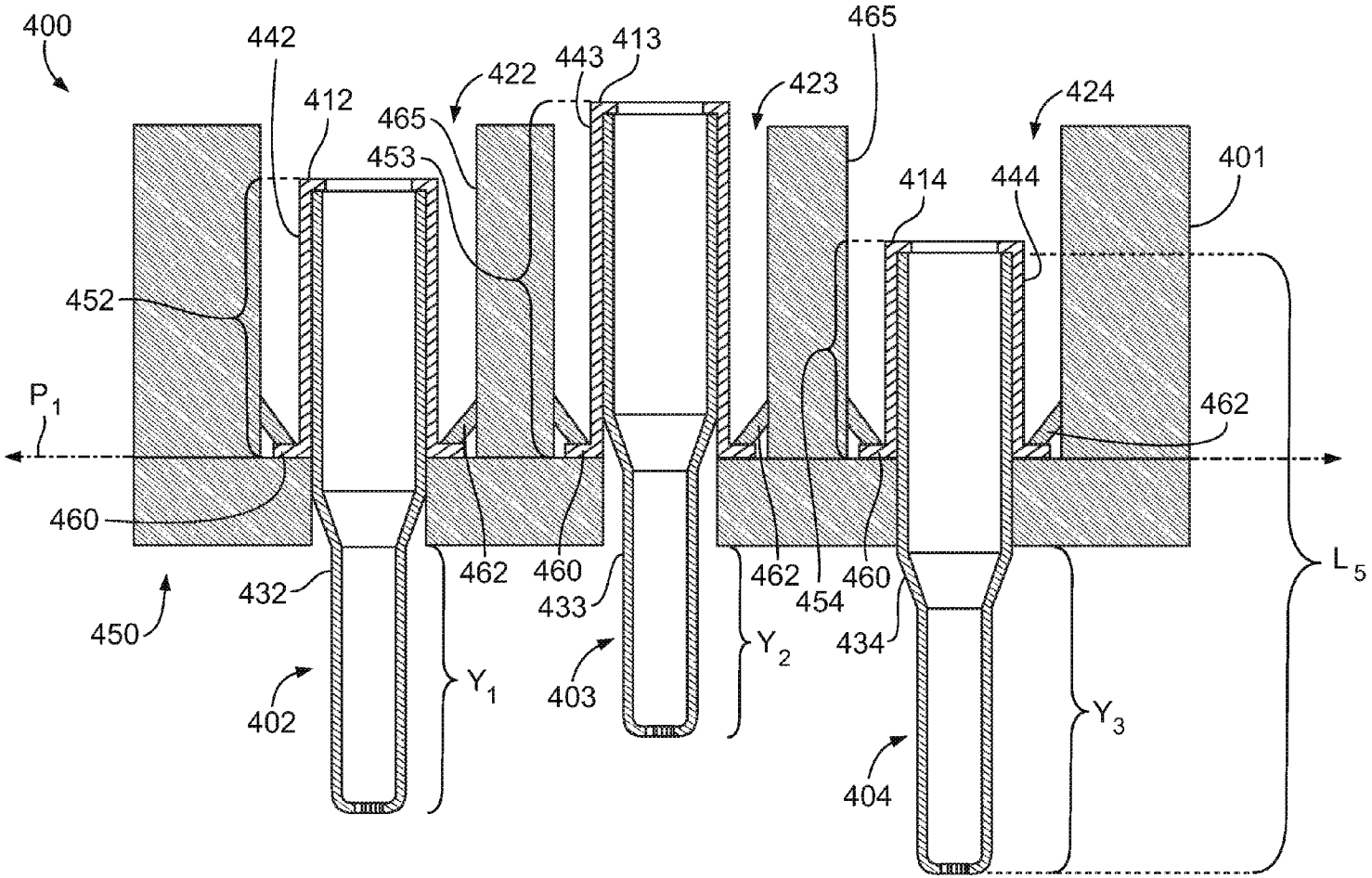
FIG. 9 is a cross-sectional view of an electrical connector assembly formed in accordance with another embodiment that includes a plurality of crimp contacts having sleeve members.

FIG. 9 is a cross-sectional view of an electrical connector assembly 400 formed in accordance with another embodiment. The connector assembly 400 may be similar to the connector assembly 102 shown in FIG. 1. The connector assembly 400 includes a connector housing 401 having a plurality of crimp contacts 402-404, which may also be referred to as a first crimp contact 402, a second crimp contact 403, and a third crimp contact 404. Each of the crimp contacts 402-404 is positioned within a respective contact cavity 422-424. The contact cavities 422-424 may be defined by corresponding interior surfaces 465 of the connector housing 401. The crimp contacts 402-404 include respective contact bodies 432-434 and sleeve members 442-444. The contact bodies 432-434 and sleeve members 442-444 may be similar to the contact bodies and the sleeve members described above. In the illustrated embodiment, the contact bodies 432-434 are substantially identical. For example, the contact bodies 432-434 may be stamped and formed as described above and have a common axial length $L_5$. However, the sleeve members 442-444 may have different dimensions with respect to each other. For example, the sleeve members 442-444 may have different axial lengths 452-454.

The crimp contacts 402-404 may project different distances $Y_1$, $Y_2$, and $Y_3$, respectively, from a mating side 450 of the connector housing 401. In such embodiments, a user may control an order or sequence in which the crimp contacts 402-404 electrically engage corresponding mating contacts of a mating connector (not shown). To assemble the connector assembly 400, the sleeve members 442-444 may be inserted into the corresponding contact cavities 422-424. When the sleeve members 442-444 are inserted, locking features 460 may engage corresponding locking elements 462 of the connector housing 401. The locking elements 462 may be resilient fingers that flex to and from the corresponding interior surface 465 of the connector housing 401. When the locking features 460 clear the locking elements 462, the locking elements 462 may spring back into position thereby retaining the sleeve members 442-444 within the connector housing 401. As shown in FIG. 9, ends of the sleeve members 442-444 may be substantially co-planar along a lateral plane $P_1$. With the sleeve members 442-444 held by the connector housing 401, the respective contact bodies 432-434 may then be inserted into the body-receiving cavities of the sleeve members 442-444, similar to FIG. 7 described above. The contact bodies 432-434 may be stopped by wall joints 412-414 of the sleeve members 442-444, respectively. Because the sleeve members 442-444 have different axial lengths 452-454, the contact bodies 432-434 project different distances $Y_1$-$Y_3$ away from the mating side 450.

In alternative embodiments, the crimp contacts 402-404 may be similar to the crimp contact 202 (FIG. 3). In such embodiments, the crimp contacts may have identical dimensions or be manufactured to have different dimensions (e.g., axial lengths).

Thus, it is to be understood that the above description is intended to be illustrative, and not restrictive. In addition, the above-described embodiments (and/or aspects thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A crimp contact comprising:

an elongated contact body having loading and mating ends and a central axis extending therebetween, the contact body comprising a contact wall that extends around the central axis and defines a conductor-receiving passage of the contact body proximate to the loading end, the contact wall having an outer surface;

a sleeve wall extending around the central axis and forming an interface with the outer surface of the contact wall proximate to the loading end, wherein the sleeve wall is sized to engage a crimping tool and the contact wall is configured to grip a conductor within the conductor-receiving passage when the sleeve and contact walls are deformed by the crimping tool; and a crimp portion and an engagement portion, the crimp portion including the sleeve wall, the engagement portion including the contact wall, the contact wall projecting beyond the sleeve wall to the mating end, the crimp portion being configured to engage the crimping tool and the engagement portion being configured to mate with an electrical component.

2. The crimp contact in accordance with claim 1, wherein the contact wall is stamped from a contact sheet of material, the contact wall being shaped to form the contact body from the loading end to the mating end.

3. The crimp contact in accordance with claim 1, wherein the crimp and engagement portions are shaped from a common contact sheet of material.

4. The crimp contact in accordance with claim 1, wherein the sleeve and contact walls form a substantially continuous radial thickness, the radial thickness being sized and shaped to deform in a predetermined manner so that the contact wall effectively grips the conductor.

5. The crimp contact in accordance with claim 1, wherein the sleeve wall extends completely around the central axis and the contact wall.

6. The crimp contact in accordance with claim 1, wherein the sleeve wall includes locking features located on an outer surface of the sleeve wall, the locking features being configured to engage a connector housing to hold the sleeve wall therein.

7. The crimp contact in accordance with claim 6, wherein the locking features include locking projections that project radially outward.

8. The crimp contact in accordance with claim 1, wherein the sleeve wall is shaped to form a separate sleeve member mounted to the contact body and having a body-receiving cavity, the body-receiving cavity of the sleeve member receiving the contact wall and forming an interference fit therewith before the crimp portion is deformed by the crimping tool.

9. The crimp contact in accordance with claim 8, wherein the sleeve member includes a wall joint that extends radially inward from the loading end, the wall joint providing a positive stop for the contact body when the contact body is inserted into the body-receiving cavity of the sleeve member.

10. A crimp contact comprising:

an elongated contact body having loading and mating ends and a central axis extending therebetween, the contact body comprising a contact wall that extends around the central axis and defines a conductor-receiving passage of the contact body proximate to the loading end, the contact wall having an outer surface; and a sleeve wall extending around the central axis and forming an interface with the outer surface of the contact wall proximate to the loading end, wherein the sleeve wall is sized to engage a crimping tool and the contact wall is configured to grip a conductor within the conductor-receiving passage when the sleeve and contact walls are deformed by the crimping tool;

wherein the contact and sleeve walls are formed from a common contact sheet of material, the sleeve wall being folded onto the contact wall at a wall joint, the wall joint extending around the central axis at the loading end.

11. The crimp contact in accordance with claim 10, wherein the contact sheet of material is shaped to include locking features that project away from the central axis and are configured to engage a connector housing to hold the sleeve wall therein.

12. An electrical connector assembly comprising:

a connector housing having opposite mounting and mating sides;

a plurality of contact cavities extending through the connector housing, the contact cavities being defined by corresponding interior surfaces of the connector housing; and a plurality of crimp contacts, each of the crimp contacts having loading and mating ends and a central axis extending therebetween, the crimp contacts being held within corresponding contact cavities, each of the crimp contacts comprising:

an elongated contact body including a contact wall that extends around the central axis and defines a conductor-receiving passage of the contact body proximate to the loading end, the contact wall having an outer surface; and a sleeve wall extending around the central axis and forming an interface with the outer surface of the contact wall proximate to the loading end, wherein the sleeve wall is sized to engage a crimping tool and the contact wall is configured to grip a conductor within the conductor-receiving passage when the sleeve and contact walls are deformed by the crimping tool; and wherein each of the crimp contacts further comprises a crimp portion and an engagement portion, the crimp portion including the sleeve wall, the engagement portion including the contact wall, the contact wall projecting beyond the sleeve wall to the mating end, the engagement portion being configured to mate with an electrical component.

13. The connector assembly in accordance with claim 12, wherein the contact and sleeve walls are formed from a common contact sheet of material, the sleeve wall being folded onto the contact wall at a wall joint, the wall joint extending around the central axis at the loading end.

14. The connector assembly in accordance with claim 12, wherein the sleeve wall includes locking features and the connector housing includes locking elements, the locking features and elements engaging each other to couple the sleeve wall to the connector housing.

15. The connector assembly in accordance with claim 12, wherein the crimp and engagement portions are shaped from a common contact sheet of material.

16. The connector assembly in accordance with claim 12, wherein the sleeve and contact walls form a substantially continuous radial thickness, the radial thickness being sized and shaped to deform in a predetermined manner so that the contact wall effectively grips the conductor.

17. The connector assembly in accordance with claim 12, wherein the sleeve wall extends completely around the central axis and the contact wall.

18. The connector assembly in accordance with claim 12, wherein the sleeve wall is shaped to form a separate sleeve member mounted to the contact body and having a body-receiving cavity, the body-receiving cavity receiving the contact body and forming an interference fit therewith before the crimp portion is deformed by the crimping tool.

19. The connector assembly in accordance with claim 18, wherein the sleeve member is configured to be positioned within the connector housing before the contact body is received by the body-receiving cavity.

20. An electrical connector assembly comprising:

a connector housing having opposite mounting and mating sides, a plurality of contact cavities extending through the connector housing, the contact cavities being defined by corresponding interior surfaces of the connector housing; and a plurality of crimp contacts, each of the crimp contacts having loading and mating ends and a central axis extending therebetween, the crimp contacts being held within corresponding contact cavities, each of the crimp contacts comprising:

an elongated contact body including a contact wall that extends around the central axis and defines a conductor-receiving passage of the contact body proximate to the loading end, the contact wall having an outer surface; and a sleeve wall extending around the central axis and forming an interface with the outer surface of the contact wall proximate to the loading end, wherein the sleeve wall is sized to engage a crimping tool and the contact wall is configured to grip a conductor within the conductor-receiving passage when the sleeve and contact walls are deformed by the crimping tool;

wherein the plurality of crimp contacts includes a first crimp contact and a second crimp contact, each of the first and second crimp contacts comprising a separate sleeve member formed from the corresponding sleeve wall, the sleeve member being mounted onto the corresponding contact body, the sleeve member having an axial length measured from the loading end toward the mating end, the contact body having an axial length measured from the loading end to the mating end, wherein the axial lengths of the contact bodies for the first and second crimp contacts are substantially equal and the axial lengths of the sleeve members of the first and second crimp contacts are different.

* * * * *